United States Patent [19]

Di Martini et al.

[11] Patent Number: 4,521,247

[45] **Date of Patent: * Jun. 4, 1985**

[54] LOW TEMPERATURE, NON-$SO_2$ POLLUTING, KETTLE PROCESS FOR SEPARATION OF LEAD FROM LEAD SULFIDE-CONTAINING MATERIAL

[75] Inventors: Carl R. Di Martini, Piscataway; Herbert E. Howe, North Plainfield, both of N.J.; William L. Scott, Tampa, Fla.; Leo J. Bulvanoski, Fords, N.J.

[73] Assignee: ASARCO Incorporated, New York, N.Y.

[ * ] Notice: The portion of the term of this patent subsequent to Jun. 8, 1999 has been disclaimed.

[21] Appl. No.: 475,210

[22] Filed: Mar. 21, 1983

Related U.S. Application Data

[63] Continuation of Ser. No. 319,556, Nov. 9, 1981, abandoned, which is a continuation of Ser. No. 132,239, Mar. 20, 1980, Pat. No. 4,333,763.

[51] Int. Cl.[3] ..... C22B 13/00

[52] U.S. Cl. ..... 75/77

[58] Field of Search ..... 75/77, 63, 78

[56] References Cited

U.S. PATENT DOCUMENTS

| | | | |
|---|---|---|---|
| 599,310 | 2/1898 | Angel | 75/77 |
| 816,772 | 4/1906 | Betts | 75/77 |
| 816,773 | 4/1906 | Betts | 75/77 |
| 821,330 | 5/1906 | Betts | 75/77 |
| 882,193 | 3/1908 | Francis | 75/77 |
| 1,786,908 | 12/1930 | Hanak | 75/77 |
| 2,110,445 | 3/1938 | Leferrer | 75/77 |
| 2,365,177 | 12/1944 | Dittmer | 75/77 |
| 2,691,575 | 10/1954 | Larson | 75/77 |
| 4,033,761 | 7/1977 | Di Martini et al. | 75/77 |
| 4,057,422 | 11/1977 | Swanson | 75/77 |
| 4,153,451 | 5/1979 | Crasto et al. | 75/77 |
| 4,333,763 | 6/1982 | Di Martini et al. | 75/77 |

*Primary Examiner*—M. J. Andrews

*Attorney, Agent, or Firm*—John J. Tomaszewski; Kenneth A. Koch

[57] ABSTRACT

Lead is separated from material containing lead sulfide, e.g., galena ore concentrate, by a substantially autogenous process involving establishing a pool of molten lead in a kettle, adding a metallic alkali metal, e.g., metallic sodium, to the molten lead in an amount sufficient to reduce the combined lead of the lead sulfide to metallic lead, adding the ore concentrate to the molten lead pool, and mixing together the metallic sodium, molten lead and ore concentrate. The sodium reacts rapidly and exothermically with the lead sulfide to reduce the combined lead of the lead sulfide to metallic lead and form sodium sulfide. The thus-liberated metallic lead reports in the molten lead pool, and a matte phase containing the sodium sulfide separates from the molten lead and forms on the surface of the molten lead pool. Lead sulfide from an excess of the ore concentrate, or other suitable added flux, which is usually added to the molten lead pool, serves to flux the sodium sulfide-containing matte phase to attain desired fluid and low melting characteristics of the matte phase. The process herein employs a kettle as the reactor, ordinarily the steel refining kettle of a lead refinery, is a low temperature process requiring temperatures above the melting point of lead but ordinarily not above 650° C., and does not discharge polluting $SO_2$ into the atmosphere.

4 Claims, 2 Drawing Figures

Fig. 1.
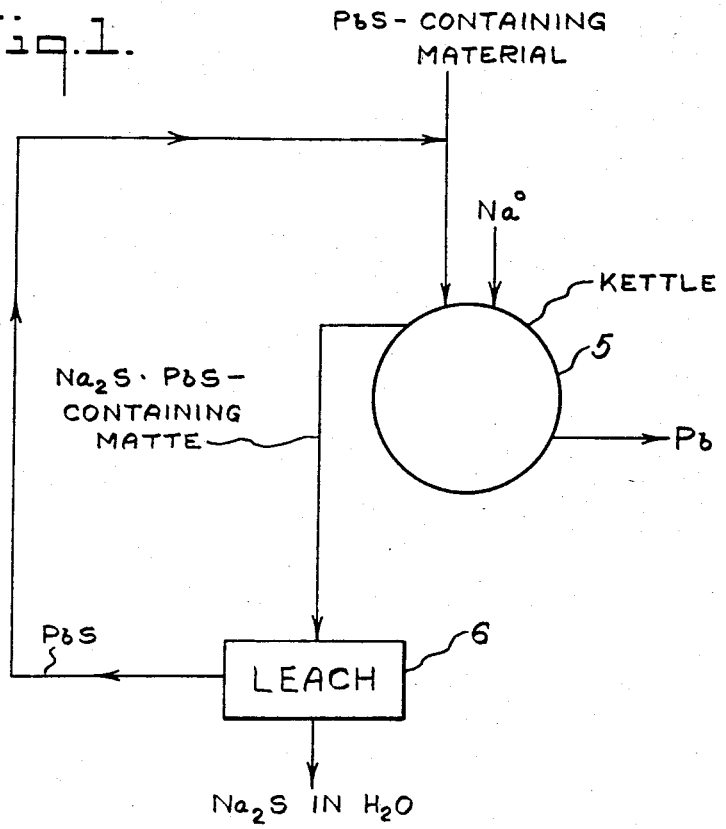
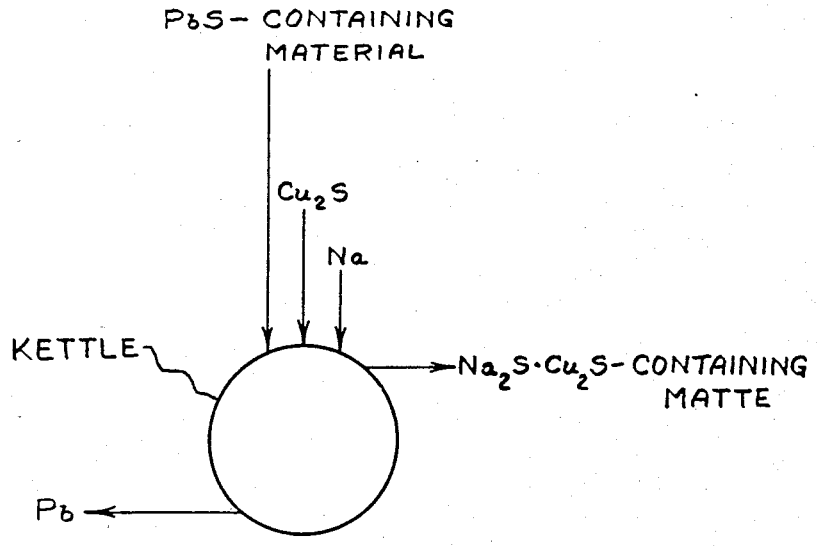
Fig. 2.

LOW TEMPERATURE, NON-$SO_2$ POLLUTING, KETTLE PROCESS FOR SEPARATION OF LEAD FROM LEAD SULFIDE-CONTAINING MATERIAL

This application is a continuation of application Ser. No. 319,556, filed Nov. 9, 1981, now abandoned, which application is a continuation of application Ser. No. 132,239, filed Mar. 20, 1980, now U.S. Pat. No. 4,333,763.

BACKGROUND OF INVENTION

1. Field of the Invention

This invention relates to the recovery of lead from lead sulfide-containing materials and more particularly to a relatively low temperature, non-$SO_2$ polluting process which is carried out in a kettle or the like, for instance a kettle ordinarily on hand in a lead refinery, and which does not require a smelting furnace or the relative high temperatures of smelting.

2. Description of the Prior Art

U.S. Pat. No. 816,773 discloses a smelting process for recovering lead from lead sulfide ore. The lead sulfide ore is smelted in a smelting furnace with a material containing a heavy metal such as iron, a carbon reducing agent, and an alkali metal, thereby producing metallic lead, an iron-alkali metal matte, and a slag containing less than five percent of ferrous oxide. U.S. Pat. No. 599,310 relates to a process for extracting lead with other metals from its ores involving mixing and heating the ore in a furnace such as a Siemens open hearth gas furnace with an alkali metal sulfate, carbonaceous material, preferably particulate coal, and oxide of zinc to fuse the mixture. The lead, which contains most of the silver and gold, is tapped off, and the zinc is volatilized and collected as zinc oxide in the furnace flue. U.S. Pat. No. 821,330 discloses a process of smelting lead sulfide ores comprising preparing a smelting charge consisting of lead sulfide ore, iron oxides, sodium sulfide or a material yielding sodium sulfide, and carbon or carbon compounds, e.g. coal or coke, and smelting the charge in preferably a reverberatory smelting furnace. U.S. Pat. No. 2,110,445 discloses a process for purifying lead bullion containing the usual small amounts of arsenic, copper, tin, antimony, bismuth and noble metals involving adding a small amount of metallic sodium to a molten bath of the bullion. The dross is thereafter skimmed from the bath at a temperature of about 330° C. thereby obtaining a lead containing less than 0.01% arsenic and less than 0.005% copper. U.S. Pat. No. 2,691,575 discloses a process for converting lead oxide to lead and particularly to the treatment of lead oxide slags obtained in the refining of impure by-product lead produced in the manufacture of tetraethyl lead. The process comprises heating a fluid mixture of lead oxide and sodium hydroxide at temperatures of from 327° C. to about 450° C., mixing with such mixture about 10% to about 30% by weight of metallic sodium based on the lead oxide, and separating molten lead from the reaction mixture. U.S. Pat. No. 4,033,761 discloses a process for the separation of copper sulfide from metallic lead mechanically entrained in a rough copper dross obtained from the copper drossing of lead bullion, involving heating the dross and an alkali metal sulfide together in a kettle at an elevated temperature not in excess of 1200° F. to melt together the dross and alkali metal sulfide. The thusobtained molten dross releases the entrained molten lead which passes to the kettle bottom, and the copper sulfide of the molten dross and the alkali metal sulfide form a low melting copper sulfide-alkali metal sulfide matte layer on the surface of a pool of the released molten lead. Although this process yields good results in separating copper sulfide and entrained metallic lead from rough copper dross, it is unsatisfactory when the rough copper dross also contains a significant quantity of lead sulfide and the aim or purpose is to recover the lead of the lead sulfide by reducing such sulfide to metallic lead in addition to separating the copper sulfide and releasing the entrained metallic lead. The reason the process of U.S. Pat. No. 4,033,761 is unsatisfactory for recovering the lead from lead sulfide in such dross is that the process will not reduce the chemically combined lead of the lead sulfide to zero valent, elemental lead.

The prior art smelting processes generated polluting $SO_2$ which was discharged into the atmosphere.

BRIEF SUMMARY OF THE INVENTION

The process of the present invention involves establishing a pool of molten lead, incorporating metallic alkali metal in the molten lead pool, and adding the material containing lead sulfide, e.g. galena ore concentrate, to the molten lead pool. The alkali metal is incorporated in the molten lead in an amount sufficient to reduce at least a significant portion, and usually at least a major portion, i.e. more than 50%, substantially all, or all, of the combined lead in the lead sulfide to zero valent metallic lead. The metallic alkali metal, molten lead and lead sulfide-containing material are mixed together, and the alkali metal reacts with the lead sulfide to reduce the chemically combined lead of the lead sulfide to zero valent, metallic lead. A matte phase separates from the molten lead, and this matte phase is separated from the molten lead pool. The liberated metallic lead reports in, i.e. passes into, the molten lead pool, and a sulfur compound or compounds of the alkali metal reports in the matte phase. The process herein is characterized by (1) being a low temperature process; (2) being a so-called kettle process capable of being carried out in a kettle which is usually a steel kettle of the type ordinarily found in a lead refinery and not requiring the employment of a costly smelting furnace such as a reverberatory or blast furnace; (3) eliminating the prior art sintering operation and hence the prior art requirements of the costly sintering plant; (4) being an autogenous or substantially autogenous process requiring, at most, little heat addition after the reaction has commenced due to the exothermic nature of the reaction; (5) economy and efficiency; (6) not generating air-polluting $SO_2$ and not generating S-containing emissions, and consequently no expensive acid plant is required to deal with $SO_2$ and no plant or special equipment is required for treating S-containing emulsion to recover S.

By the term "kettle" as used herein is meant any suitable vessel, receptacle, container, or reactor, exclusive of a smelting furnace such as a reverberatory smelting furnace or blast furnace, and usually the steel kettle of the type ordinarily found and utilized in a lead refinery for refining lead.

A flux or fluxing agent, e.g. a sulfide-bearing material or caustic alkali, is usually added to the reaction mixture or to the matte phase in amount which is sufficient to form a low-melting and fluid matte phase on the surface of the molten lead. The function of the fluxing agent is to provide a desirable fluid matte phase of low melting temperature. If the fluxing agent is not added to the matte phase, the matte phase is too refractory, i.e. has too high melting temperature. Exemplary of the sulfide-bearing material as fluxing agent are non-ferrous metal sulfide-containing ore concentrates, e.g. copper sulfide ore concentrate, and lead sulfide ore concentrate. When lead sulfide ore concentrate is utilized as fluxing agent, it can conveniently be provided by adding an excess of the lead sulfide-containing material, e.g. galena concentrate, to the molten lead pool.

The reduction of the lead sulfide to metallic lead by reaction with the metallic alkali metal, e.g. metallic sodium, is rapid and exothermic and, except for the heat required at the outset to melt the lead and maintain it molten, at most appreciably less external heat, or no external heat, input is required after the reduction reaction with the metallic alkali metal has commenced than prior to the commencement of such reaction. Such reduction of the lead sulfide to metallic lead by reaction with the metallic alkali metal is carried out an an elevated temperature of the molten lead pool which is above the melting point of the lead. The temperature of the molten lead pool is usually in the range above the melting point of metallic lead up to but not above 650° C. and is typically in the range of between about 345° C. and about 500° C. This relatively low temperature reduction is contrasted with the relatively high temperatures of the prior art smelting process employing a smelting furnace and requiring temperatures of about 1095° C.-1150° C. and higher.

The metallic alkali metal utilizable herein as reducing agent is exemplified by metallic sodium, potassium and lithium. The equations for the reduction of the lead sulfide by the alkali metals of the examples set forth immediately above, follow:

$$2Na^{\circ} + PbS \rightarrow Na_2S + Pb^{\circ}$$

$$2K^{\circ} + PbS \rightarrow K_2S + Pb^{\circ}$$

$$2Li^{\circ} + PbS \rightarrow Li_2S + Pb^{\circ}$$

The molten lead of the molten lead pool can be any suitable lead. Exemplary of the lead is common or ordinary metallic lead, corroding grade lead, and lead containing arsenic, antimony, bismuth or silver.

The process of this invention can also be practiced with good results to recover lead from a dross containing lead sulfide and copper sulfide and having metallic lead entrained or occluded in the dross. Such dross is exemplified by the rough copper dross, also known as rough dross or de-copperizing dross, obtained from the rough copper drossing of lead bullion by the liquating of molten lead bullion in conventional manner by cooling the molten lead to a temperature of typically about 450° C. A copper-containing dross separates from the molten lead bullion on the surface of the bullion as a result of the liquating, and the dross is separated from the molten lead usually by skimming. This dross obtained from the rough drossing is a low Cu content, high Pb content dross containing typically, by weight, about 15% $Cu_2S$, 41% PbS, and 41% metallic Pb mechanically entrained or occluded in the dross. In this embodiment of the invention, the metallic alkali metal, e.g. metallic sodium, exothermically reacts preferentially with the lead sulfide of the dross to reduce the combined lead of the lead sulfide to elemental lead and form alkali metal sulfide. The thus-formed alkali metal sulfide, e.g. sodium sulfide, combines or reacts with the copper sulfide to form a relatively low-melting, fluid matte phase and results in the release of the occluded metallic lead from the dross. Both the lead resulting from the reduction of the lead sulfide and the released lead which was previously occluded in the dross report in the molten lead pool.

The occluded metallic lead is released from the rough copper dross by reason of the matrix of the dross melting away, thereby releasing the metallic lead. The copper sulfide, $Cu_2S$, of the rough copper dross is a relatively high melting refractory material melting at 1100° C. The sodium sulfide, formed by the reduction of the lead sulfide with metallic sodium, is also a relatively high melting, refractory material melting at 1180° C. When the $Cu_2S$ is present together with the $Na_2S$ in the matte, however, a relatively low melting, non-refractory material, $Cu_2S.Na_2S$, is obtained, which melts in the 480° C.-600° C. range. The formation of this low melting, non-refractory material by the combining of the $Cu_2S$ and $Na_2S$ appears to enable the melting away of the dross matrix with the consequent release of the occluded metallic lead.

The recovery of the entrained metallic lead from the dross obtained from the rough copper drossing of lead bullion, in accordance with the embodiment of the process set forth previously herein, results in a high copper, low lead matte, for instance a matte containing, by weight, about 29% Cu and about 3% Pb, which can be shipped and treated at the copper smelter at a considerable lower cost than if the entrained metallic lead is left in the dross. This is readily appreciated by the release and recovery of 82 tons of the Pb, or 98.7% of the Pb charged, from 110 tons of the rough copper dross of low Cu content (about 12% copper) and high Pb content (about 76% Pb) in plant scale testing employing the process herein and using an existing kettle and other equipment at the lead refinery. 34 tons of the high copper (about 29%) low Pb (about 3%) matte resulted from the 110 tons of copper dross charged. The considerable savings in shipping the 34 tons of matte to the copper smelter as compared with 110 tons of the rough copper dross is readily seen. Further, there are difficulties in storing, handling, and charging the rough copper dross at the lead smelter inasmuch as the copper dross is obtained as large, awkward-to-handle pieces of dross. Moreover, it is not desirable to change the high Pb content (about 76% Pb), low Cu content (about 12% Cu) to the copper smelting furnace, and such a high Pb content charge is disadvantageous to the copper circuit. These difficulties are overcome by the high Cu (about 29% Cu), low Pb (about 5% Pb) content matte produced by the process of this invention which is readily stored and handled and is feasibly charged to the copper smelting furnace.

BRIEF DESCRIPTION OF THE DRAWING

FIG. 1 is a schematic flow diagram of the process in accordance with the invention; and FIG. 2 is a schematic flow diagram in accordance with another embodiment of the invention.

DETAILED DESCRIPTION OF THE DRAWINGS

With reference to FIG. 1, metallic alkali metal, e.g. sodium, is introduced onto the surface of a pool or bath of molten lead and/or beneath the surface of the molten lead pool in kettle 5, which is equipped with a conventional propeller stirrer (not shown) and a burner for heating the contents of the kettle. The alloying or mixing of the metallic sodium with the metallic lead is exothermic and results in the temperature of the melt pool being increased. Lead sulfide-containing material, e.g. galena ore concentrate, is also introduced onto the surface of the pool of molten lead in kettle 5. An excess of the galena ore concentrate over that required to stoichiometrically react with the metallic alkali metal to form metallic or elemental Pb and alkali metal sulfide is fed onto the molten lead pool surface to serve as fluxing agent for the matte phase. A lead sulfide- and copper sulfide-containing dross, or any other lead sulfide-containing material which is susceptible to the process of the present invention for separating the lead therefrom, can, if desired, be substituted for the galena ore concentrate and introduced onto the molten lead pool surface. The propeller mixer which operates in kettle 5 produces a vortex in the molten metal, which draws the galena ore concentrate and metallic sodium downwardly into the interior of the molten lead pool and mixes the ore concentrate and sodium together in the molten lead pool and disperses the ore concentrate and sodium throughout the pool. The metallic lead pool is at elevated temperature above the melting temperature of lead, and typically at temperature in the range of about 345° C. to 500° C. The galena ore concentrate and metallic sodium are mixed together in the molten lead pool for a period of typically about 5 minutes to about 10 minutes.

The metallic sodium reacts rapidly and exothermically with the lead sulfide in the molten lead pool to reduce the divalent lead of the lead sulfide to zero valent metallic lead, and form a sulfur compound or compounds of the sodium, e.g. $Na_2S$. The thus-liberated metallic lead reports in, i.e. passes into, the molten lead pool. The $Na_2S$ passes into a matte phase which also contains PbS from the excess galena ore concentrate as flux, the matte phase separating from the molten lead pool as a $Na_2S$-and PbS-containing matte layer on the surface of the molten lead pool.

Metallic lead, usually in molten state, is withdrawn or otherwise recovered from the lead pool.

The matte layer is a relatively low melting, non-refractory, fluid layer, which is apparently due to the formation of a low-melting eutetic between the PbA and $Na_2S$, and may be readily removed by skimming or otherwise separated, as desired, from the molten pool surface.

The matte layer is preferably leached in a suitable vessel or container 6 with a leachant, usually an aqueous liquid and preferably water, to dissolve the sodium sulfide in the matte to the substantial exclusion of the lead sulfide. The thus-obtained sodium sulfide-containing solution is then separated from the solid lead sulfide in vessel 6, and the lead sulfide returned to kettle 5 and introduced into the molten lead pool in the kettle 5. Prior to being returned to kettle 5, the lead sulfide, which may have gangue associated therewith, may be transferred to a flotation cell for separation of the gangue.

Referring to FIG. 2, the process is substantially the same as in the description previously set forth herein with regard FIG. 1, except that in the process in accordance with FIG. 2, $Cu_2S$ is added onto the surface of the molten lead pool as fluxing agent in sufficient amount to provide the low-melting, fluid matte and the excess galena ore concentrate is not added as flux in this FIG. 2 embodiment. Also in this process embodiment in accordance with FIG. 2, the $Na_2S.Cu_2S$-containing matte which is skimmed off the molten lead pool is not leached as in the FIG. 1 process but instead is shipped to a copper smelter for recovery of the copper.

DESCRIPTION OF THE PREFERRED EMBODIMENTS

The preferred metallic alkali metal for use herein is metallic sodium.

Preferably, when lead sulfide is the fluxing agent, the lead sulfide is recovered from the separated matte, and the recovered lead sulfide is returned to and added to the molten lead pool for mixing with the other reactants. The lead sulfide is preferably recovered from the separated matte by leaching with a leachant, preferably water, which dissolves the sodium sulfide to the exclusion of the lead sulfide. Any leachant capable of dissolving the sodium sulfide but incapable or substantially incapable of dissolving lead sulfide can be utilized for the leaching.

The preferred temperature of the molten lead pool during the addition of the reactants thereto is in the range of above the melting point of metallic lead up to but not above 500° C., more preferably in the range from 345° C. to 500° C.

The lead sulfide ore concentrate utilized herein is preferably a high grade lead concentrate of about 80% or higher Pb content.

In the embodiment of the invention for recovering lead from dross obtained from the rough copper drossing of lead bullion, the metallic alkali metal such as metallic sodium is preferably incorporated in the molten lead pool by introducing the sodium beneath the surface of the molten lead pool while avoiding contact of the metallic sodium, during the introducing, with the dross on the lead pool surface. The reason for this is that a violent reaction accompanies the melting of metallic sodium over and in contact with the rough copper dross. More preferably the sodium is introduced beneath the lead pool surface, without contacting the rough copper dross on the pool surface, by feeding the metallic sodium in molten state through a refractory pipe or tube, for instance a steel pipe, which is positioned to extend through the copper dross layer on the lead pool surface and terminate in an outlet opening beneath pool surface.

The following examples further illustrate the invention:

EXAMPLE 1

Twelve hundred (1200) grams of corroding grade lead were melted by heating at a temperature of about 345° C. in a small steel vessel set in an electric furnace, to form a molten lead pool. 23.6 grams of metallic sodium were added to the molten lead pool to produce a lead 2% sodium alloy. Pure lead sulfide in the amount of 239 grams was then supplied onto the top surface of the molten lead-sodium pool. A portion of this lead sulfide serves as flux to provide a fluid, low melting matte with the by-product $Na_2S$ on the surface of the molten lead pool. The molten lead pool was stirred by means of a mechanical stirrer during addition to the melt pool of the lead sulfide and metallic sodium to obtain good mixing of the reactants.

The metallic sodium reacted rapidly and highly exothermically with the lead sulfide to reduce the lead of the PbS to metallic lead and form sodium sulfide. The thus-liberated elemental lead passed into the molten lead pool. The sodium sulfide separated from the molten lead and formed with a portion of the lead sulfide a fluid, low-melting matte phase on the top surface of the molten lead pool.

By reason of the rapid and highly exothermic nature of the reaction between the metallic sodium and lead sulfide, little heat input to the melt pool was required after the addition of the metallic sodium and lead sulfide.

When the reaction between the metallic sodium and lead sulfide was complete, which was indicated by the presence of a fluid matte on the surface of the bath, the entire mixture was poured into an ingot mold. After the ingot was solid, the matte was broken off and the elemental lead and matte were separately weighed. The recovery yield of elemental lead from that lead sulfide reacted with sodium was 94.9%.

The matte, which was a eutectic matte of 26% $Na_2S$-74% PbS, had a melting point of 520° C. The $Na_2S$ is readily separated from the matte by leaching with water, thereby dissolving the $Na_2S$, and enabling recycling the PbS back to the kettle.

EXAMPLE 2

The process of Example 1 is repeated except that 40 grams of copper sulfide is also added onto the top surface of the molten lead pool and 115 grams of pure lead sulfide is added to the molten lead-sodium alloy pool in this Example 2. The purpose of the copper sulfide concentrate is to flux the by-product sodium sulfide in the matte phase to form a fluid, low melting matte phase. The molten lead pool is stirred by means of a mechanical stirrer during addition to the melt pool of the lead sulfide, copper sulfide, and sodium.

The metallic sodium reacts rapidly and highly exothermically with the lead sulfide to reduce the lead of the PbS to metallic lead and form sodium sulfide. The thus-liberated metallic lead passes into the molten lead pool, and the sodium sulfide separates from the molten lead and forms with the copper sulfide and perhaps some of the lead sulfide a fluid low melting matte on the top surface of the molten lead pool.

By reason of the rapid and highly exothermic nature of the reaction between the metallic sodium and lead sulfide, no heat input, or at most, an appreciably reduced heat input, is required for the melt pool after the addition of the metallic sodium and lead sulfide.

EXAMPLES 3 through 6

In plant scale Na metal treatment of a low Cu high Pb rough dross containing, by weight, about 12% Cu and about 76% Pb obtained from the copper drossing of lead bullion, the Na metal treatment successfully and rapidly reduced a total of about 110 tons of the rough dross to 34 tons of high Cu low Pb matte containing, by weight, 29% Cu and 3% Pb and resulted in the recovery at the lead refinery of 82 tons of the Pb, which was 98.7% of the Pb charged. Consequently the matte, which is shipped to the copper smelter, is a desirable higher Cu content, lower Pb content, low-melting matte which is relatively easy to handle and treat at the copper smelter for recovery of Cu as contrasted with the more difficult to handle and ship chunks of the rough dross having the relatively low copper content and relatively high Pb content and hence not as amenable for addition to the copper circuit at the smelter. Considerable monetary savings are achieved in lower freight charges due to avoiding having to ship the 82 tons of lead, which are recovered at the lead refinery, to the copper smelter.

In conducting the plant scale process runs of Examples 3 through 6, sticks of Na metal each weighing 12 lbs. were manually loaded into a pool of approximately 125 tons of molten previously rough drossed Pb in a steel refining kettle equpped with a burner and a mixer. The Na sticks were introduced into a vortex produced in the molten lead pool by the operating mixer. The temperature of the molten Pb bath rose from about 500° C. to about 625° C. due to the Na addition. At this temperature the kettle burner was reduced to three-quarter fire for the remainder of the test.

The dross obtained from the copper drossing of lead bullion was then added to the molten lead pool. About $\frac{1}{4}$–$\frac{1}{3}$ of the total amount of dross to be added was introduced at a time. The vortex draws the pieces of dross down into the molten pool, insuring good contact between the Na in the bath and the dross. Within minutes some localized fluid matting reaction at the dross-Na-Pb interface was observed. Subsequent additions of the dross to the molten lead pool resulted in more extensive liquification of the granular matte produced in previous stages, promoting further separation of mechanically entrained Pb. Some working of the granular matte toward the vortex with push boards was advantageous in promoting the liquification of the matte. The final dross addition brought the added weight of dross to about 11–13 times the amount of Na present in the pool or bath. The dross-bath reaction took about 1–1.5 hours. At this stage matte liquification was completed and preheating of the matte molds was initiated. When all dross-bath reaction had ceased, the mixer was withdrawn in preparation for floating off the inky, black, fluid matte layer, which typically was about 9 inches thick. Push boards assisted in matte removal. Ladling of previously rough drossed molten Pb to displace remaining matte was made as required. As soon as molten Pb was observed to run from the launders, which was about $\frac{1}{2}$ hour after tapping the matte, the exits were blocked with fire clay. After ladling Pb to the refinery to regain the initial freeboard in the kettle, the treatment operation was ready to be repeated.

The results, materials balance, and chemical analysis for the plant scale tests of Examples 3, 4, 5 and 6 are set forth hereafter in Tables A, B, C and D respectively:

TABLE A

| Totals (lbs) | | Pb | Cu | S | Na | Fe | Totals |
|---|---|---|---|---|---|---|---|
| | | | EXAMPLE 3 | | | | |
| 423,170 | Rough Drossed Lead | Remainder 422,780 | 0.088% 370 | 55 ppm 20 | 2 ppm 1 | 5 ppm 2 | 100% 423,170 lbs |
| | + | — | — | — | Remainder | — | 100% |
| 3,800 | Sodium | — | — | — | 3,800 | — | 3,800 lbs |
| | + | 73.3% | 12.4% | 8.3% | — | 2.3% | 96.3%* |
| 45,480 | Rough Dross | 33,340 | 5,660 | 3,760 | — | 1,060 | 43,820 lbs |
| 427,450 | Total | 456,120 | 6,030 | 3,780 | 3,800 | 1,060 | 470,790 lbs |

TABLE A-continued

| Totals (lbs) | | Pb | Cu | S | Na | Fe | Totals |
|---|---|---|---|---|---|---|---|
| | | | EXAMPLE 3 | | | | |
| | (lbs) | | | | | | |
| 14,500 | Matte | 3.3% | 25.8% | 26.0% | 26.2% | 7.3% | 88.6%** |
| | | 480 | 3,740 | 3,770 | 3,800 | 1,060 | 12,850 lbs |
| | + | Remainder | 0.50% | 21 ppm | 4 ppm | 1 ppm | 100% |
| 457,950 | Bath | 455,640 | 2,290 | 10 | 2 | — | 457,940 lbs |
| 472,450 | Total (lbs) | 456,120 | 6,030 | 3,780 | 3,800 | 1,060 | 470,790 lbs |

Matte Produced = 31.9% Dross Charged
Dross/Sodium = 12.0
*Remainder ~2% Zn, <1% Sb, Co, Ni
**Remainder ~5% Zn, <1% Sb, As, Sn, Co, Ni

TABLE B

| Totals (lbs) | | Pb | Cu | S | Na | Fe | Totals |
|---|---|---|---|---|---|---|---|
| | | | EXAMPLE 4 | | | | |
| 410,990 | Rough Drossed Lead | Remainder | 0.10% | 3 ppm | <5 ppm | 2 ppm | 100% |
| | | 410,580 | 410 | 1 | <1 | 1 | 410,990 lbs |
| | + | — | — | — | Remainder | — | 100% |
| 3,900 | Sodium | — | — | — | 3,900 | — | 3,900 lbs |
| | + | 73.9% | 14.6% | 8.3% | — | 1.0% | 97.8%* |
| 51,620 | Rough Dross | 38,190 | 7,530 | 4,290 | — | 500 | 50,510 lbs |
| 466,510 | Total (lbs) | 448,770 | 7,940 | 4,290 | 3,900 | 500 | 465,400 lbs |
| 16,670 | Matte | 5.8% | 35.5% | 25.6% | 23.4% | 3.0% | 93.3%** |
| | | 970 | 5,920 | 4,270 | 3,900 | 500 | 15,560 lbs |
| | + | Remainder | 0.45% | 38 ppm | 5 ppm | 2 ppm | 100% |
| 449,840 | Bath | 447,800 | 2,020 | 17 | 2 | 1 | 449,840 lbs |
| 466,510 | Total (lbs) | 448,770 | 7,940 | 4,290 | 3,900 | 500 | 465,400 lbs |

Matte Produced = 32.3% Dross Charged
Dross/Sodium = 13.2
*Remainder ~2% Zn, <1% Sb, Co, Ni
**Remainder ~5% Zn, <1% Sb, As, Sn, Co, Ni

TABLE C

| Totals (lbs) | | Pb | Cu | S | Na | Fe | Totals |
|---|---|---|---|---|---|---|---|
| | | | EXAMPLE 5 | | | | |
| 398,600 | Rough Drossed Lead | Remainder | 0.26% | 1 ppm | 5 ppm | 2 ppm | 100% |
| | | 397,560 | 1,040 | — | 2 | 1 | 398,600 lbs |
| | + | — | — | — | Remainder | — | 100% |
| 5,250 | Sodium | — | — | — | 5,250 | | 5,250 lbs |
| | + | 77.9% | 11.1% | 8.0% | — | 0.9% | 97.9%* |
| 61,330 | Rough Dross | 47,770 | 6,800 | 4,890 | — | 550 | 60,010 lbs |
| 465,180 | Total (lbs) | 445,330 | 7,840 | 4,890 | 5,250 | 550 | 463,860 lbs |
| 17,210 | Matte | 2.1% | 28.1% | 28.4% | 30.5% | 3.2% | 92.3%** |
| | | 360 | 4,840 | 4,890 | 5,250 | 550 | 15,890 lbs |
| | + | Remainder | 0.67% | 1 ppm | 5 ppm | 2 ppm | 100% |
| 447,970 | Bath | 444,970 | 3,000 | — | 2 | 1 | 447,970 lbs |
| 465,180 | Total (lbs) | 445,330 | 7,840 | 4,890 | 5,250 | 550 | 463,860 lbs |

Matte Produced = 28.1% Dross Charged
Dross/Sodium = 11.7
*Remainder ~2% Zn, <1% Sb, Co, Ni
**Remainder ~5% Zn, <1% Sb, As, Sn, Co, Ni

TABLE D

| Totals (lbs) | | Pb | Cu | S | Na | Fe | Totals |
|---|---|---|---|---|---|---|---|
| | | | EXAMPLE 6 | | | | |
| 494,000 | Rough Drossed Lead | Remainder | 0.67% | <1 ppm | 5 ppm | 1 ppm | 100% |
| | | 490,690 | 3,310 | — | 2 | — | 494,000 lbs |
| | + | — | — | — | Remainder | — | 100% |
| 6,000 | Sodium | — | — | — | 6,000 | | 6,000 lbs |
| | + | 77.5% | 10.3% | 9.1% | — | 0.9% | 97.8%* |
| 61,430 | Rough Dross | 47,610 | 6,340 | 5,590 | — | 540 | 60,080 lbs |
| 561,430 | Total (lbs) | 538,300 | 9,650 | 5,590 | 6,000 | 540 | 560,080 lbs |

TABLE D-continued

| Totals (lbs) | | Pb | Cu | S | Na | Fe | Totals |
|---|---|---|---|---|---|---|---|
| | | | EXAMPLE 6 | | | | |
| 19,350 | Matte | 2.1% | 28.3% | 28.8% | 31.0% | 2.8% | 93.0%** |
| | | 410 | 5,480 | 5,570 | 6,000 | 540 | 18,000 lbs |
| | + | Remainder | 0.77% | 31 ppm | 5 ppm | 1 ppm | 100% |
| 542,080 | Bath | 537,890 | 4,170 | 17 | 3 | — | 542,080 lbs |
| 561,430 | Total (lbs) | 538,300 | 9,650 | 5,590 | 6,000 | 540 | 560,080 lbs |

Matte Produced = 31.5% Dross Charged
Dross/Sodium = 10.2
*Remainder ~2% Zn, <1% Sb, Co, Ni
**Remainder ~5% Zn, <1% Sb, As, Sn, Co, Ni The calculated sulfide compositions for the dross and matte of the plant scale tests of Examples 3 through 6 are set forth in Table E which follows:

TABLE E

CALCULATED PLANT TEST SULFIDE COMPOSITIONS FOR DROSS AND MATTE PLANT TESTS OF EXAMPLES 3-6 AND OVERALL AVERAGE

| | Example 3 | Example 4 | Example 5 | Example 6 | Overall Average |
|---|---|---|---|---|---|
| | | | Dross | | |
| % $Cu_2S$ | 28.7% | 34.7% | 26.4% | 20.4% | 27.2% |
| % PbS | 71.3% | 65.3% | 73.6% | 79.6% | 72.8% |
| | | | Matte | | |
| % $Na_2S$ | 55.1% | 45.8% | 59.2% | 59.5% | 53.8% |
| % $Cu_2S$ | 40.2% | 51.3% | 40.3% | 40.0% | 41.9% |
| % PbS | 4.7% | 2.9% | 0.5% | 0.5% | 4.3% |

What is claimed is:

1. A process for separating lead from a material containing lead sulfide whih comprises:

(a) reacting in a kettle a mixture comprising molten lead, lead sulfide and copper sulfide with metallic alkali metal;

(b) the metallic alkali metal reacting with the lead sulfide to reduce the combined lead of the lead sulfide to metallic lead and forming a matte phase comprising a sulfur compound of the alkali metal and the copper sulfide separating from the molten lead;

(c) the thus-liberated metallic lead reporting in the molten lead, and the sulfur compound of the alkali metal and the copper sulfide being present in the matte phase; and (d) separating the matte phase from the lead phase.

2. The process of claim 1 wherein the metallic alkali metal is sodium.

3. The process of claim 2 wherein the sodium metal is molten.

4. The process of claim 1 wherein the reaction mixture is mainly molten lead.

* * * * *